United States Patent [19]

Allen et al.

[11] 4,337,059

[45] Jun. 29, 1982

[54] CARTON BOTTOM TUCKING AND TACKING APPARATUS WITH PIVOTAL TUCKER WINGS FOR PACKAGING MACHINES

[76] Inventors: Robert J. Allen, 23025 Manning, Farmington, Mich. 48024; Ivan L. Kauffman, 5145 Elkin Rd., Commerce Township, Oakland County, Mich. 48085

[21] Appl. No.: 51,785

[22] Filed: Jun. 25, 1979

[51] Int. Cl.[3] ..... B31B 1/28

[52] U.S. Cl. ..... 493/184; 493/165

[58] Field of Search ..... 93/44.1 GT, 44.1 R, 93/44, 49 R; 53/373, 374

[56] References Cited

U.S. PATENT DOCUMENTS

| | | | |
|---|---|---|---|
| 3,212,413 | 10/1965 | Allen et al. | 93/44.1 GT |
| 3,507,095 | 4/1970 | Kuhnle | 93/44.1 R X |
| 3,579,958 | 5/1971 | Hentges | 93/44.1 GT X |
| 3,593,625 | 7/1971 | Garrett et al. | 93/44.1 GT X |

*Primary Examiner*—James F. Coan

[57] ABSTRACT

A carton bottom end tucker-tacker assembly for folding over, closing and tacking the bottom ends of a pair of cartons mounted on a pair of mandrels at a tucker-tacker station on a carton packaging machine. The tucker-tacker apparatus includes a tucker apparatus for engaging a pair of opposed triangular bottom end closure members on the bottom ends of each of a pair of stationary cartons and breaking the bottom end closure members and folding them inwardly toward a closed position, after which the tucker apparatus recedes and a pair of swingably mounted tucker and tacker jaws then move under the partially closed bottom end members of each of the pair of cartons and complete the folding and tucking operations, and concluding with a tacking in place of the bottom end closure tuck-over panel on each carton to retain the bottom end closure members in a square condition for subsequent transferral to a carton bottom end pressure sealing station. The tucker jaws and the tacker jaws are each water cooled, and they are adapted to be operated by the same power drive means as used to operate the tucker apparatus. The tucker-tacker apparatus comprises a pair of swingably mounted tucker wings, for each of said pair of cartons, which swing inwardly and outwardly in planes transverse to the direction of movement of the pair of cartons in and out of the tucker-tacker station. The tucker and tacker jaws of each pair of said jaws are pivotally mounted on an axis that is disposed transverse to the direction of movement of a pair of cartons in and out of the tucker-tacker station.

5 Claims, 21 Drawing Figures

24
21
14
78
67
14a
15a
13
21
15
24
3
20
25
86
20
25
157
85
85
81
179
164
202
76
75
67
77
173
180
81
68
26
74
206
69
73
188
183
167
80
207
80
26
182
187
184
79
185
176
186
55
52
282
214
212
29
30
32
176a
29
30
47
47
49
4
4
190
49
191
43
208
32
45
33
43
46
220
46
44
33
200
209
38
192
37
44
52a
218
193
194
222
37
195
196
189

60
64
232
230
64
228
61
63
62
3

CARTON BOTTOM TUCKING AND TACKING APPARATUS WITH PIVOTAL TUCKER WINGS FOR PACKAGING MACHINES

TECHNICAL FIELD

This invention relates generally to the packaging machine art, and more particularly to a carton bottom tucker-tacker assembly for use with carton packaging machines. The invention is specifically concerned with a tucker-tacker assembly for simultaneously tucking and tacking the bottom closure members of two cartons at a carton bottom end closing station in a carton packaging machine.

BACKGROUND ART

It is known in the packaging machine art to provide tucking apparatuses for folding and tucking the bottoms of cartons, and then moving the cartons directly into a sealing station without any intermediate tacking of the folded carton bottoms. A disadvantage of the prior art tucking apparatuses is that after the carton bottom ends have been folded and tucked, they must be held in position while they are slid along guide rails to a carton bottom pressure sealing station in the packaging machine. The last mentioned sliding movement of folded carton bottoms causes a backdrag on the carton bottoms, which in many instances moves the carton bottom closure members off balance, so that they are not sealed squarely in the subsequent sealing operation. A further disadvantage of the prior art tucking apparatuses is that they are not readily adaptable for use in a packaging machine which is adapted to index more than one carton along a carton processing path. Another disadvantage of the prior art carton bottom tucking apparatuses is that they are costly and employ many parts, and they are difficult to repair. Examples of the prior art carton bottom tucking apparatuses are disclosed in U.S. Pat. Nos. 3,120,089; 3,166,994; 3,183,801; 3,187,647; 3,212,413; and 3,398,659.

DISCLOSURE OF THE INVENTION

This invention relates to the carton or container packaging art, and to a tucker-tacker assembly for simultaneously performing a carton bottom closing and tacking operation on a pair of cartons, in a packaging machine for forming, filling and closing cartons, and wherein said packaging machine is an indexing packaging machine which indexes cartons in pairs through various work stations to accomplish forming, filling and sealing of the cartons.

The tucker-tacker assembly includes two sets of tucker wings, with each set including a pair of oppositely disposed, pivotally mounted tucker wings that are pivotally mounted on spaced axes which are parallel to the direction of movement of a pair of cartons into and out of the station at which the tucker-tacker assembly is operatively disposed. The tucker wings move inwardly and outwardly in a direction transverse to said direction of carton movement. The two sets of tucker wings simultaneously break, and partially fold, a pair of oppositely disposed triangular or gusset bottom end closure members on each of a pair of cartons disposed in side-by-side relationship on a pair of mandrels carried on a packaging machine at the tucker-tacker station. The tucker-tacker assembly further includes two sets of folding jaws which complete the folding of the bottom end closure members of the pair of cartons and tack them in closed positions. Each set of jaws includes a swingably mounted tucker jaw and an oppositely disposed tacker jaw. The tucker and tacker jaws, of each set of jaws, are pivotally mounted on an axis that is disposed transversely to the direction of movement of a pair of cartons in and out of the tucker-tacker station.

The tucker jaw of each set of jaws folds the tuck-in flap of the bottom end closure members on one of the cartons into a folded position for overlapping engagement by the tuck-over flap of the bottom end closure members on the same carton. The tuck-over flap is then folded to a closed position by a tacker jaw which tacks the bottom end closure members in place. The tucker and tacker jaws are then each moved to an inoperative position, and the two cartons, with tucked bottom ends, are moved to the carton bottom sealing station in the packaging machine. The tucker wings, the tucker jaws, and the tacker jaws are all operated in a predetermined sequence by a single power drive means which is driven by the main drive shaft of the packaging machine with which the tucker-tacker assembly is associated.

BEST MODE OF CARRYING OUT THE INVENTION

Figure 1:
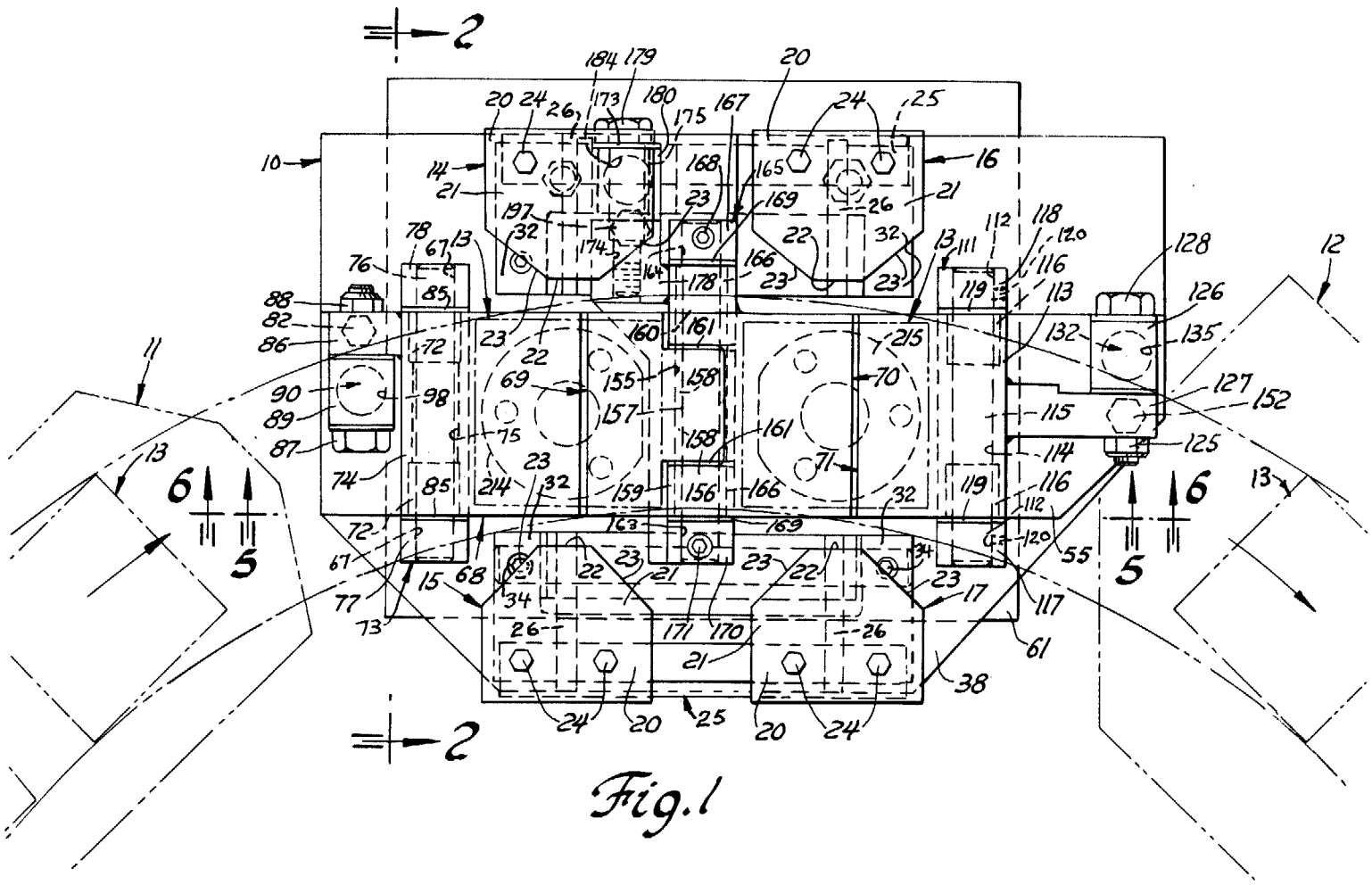
FIG. 1 is a top plan view of a carton bottom tucker-tacker assembly made in accordance with the principles of the present invention.

Referring now to the drawings, and in particular to FIG. 1, the numeral 11 generally designates a carton bottom heater station on a conventional rotary turret which is rotatable clockwise, as viewed in FIG. 1. The rotary turret is of the type which carries two mandrels at each station, and which indexes two mandrels from one work station to the next work station. The numeral 10 generally designates a carton bottom tucker-tacker assembly made in accordance with the principles of the present invention. The numeral 12 generally designates a carton bottom pressure station at which the carton bottoms are sealed by a conventional sealing apparatus.

The numerals 13, in the carton bottom tucker-tacker assembly 10 of FIG. 1, generally designate a pair of half-gallon size cartons which are simultaneously tucked and tacked by the tucker-tacker assembly 10 of the present invention. However, it will be understood that the tucker-tacker assembly 10 of the present invention may be employed for tucking and tacking the bottom ends of cartons of sizes other than a half-gallon size.

As shown in FIG. 1, the numerals 14 and 15 generally designate a first pair of oppositely disposed, pivotally mounted, tucker wings which are adapted to perform a breaking and partial folding operation on the bottom end closure members of the trailing one of the two illustrated cartons 13. A second pair of oppositely disposed, pivotally mounted tucker wings, generally indicated by the numerals 16 and 17, are mounted in a laterally spaced apart position from the first pair of tucker wings 14 and 15, for performing a breaking and tucking operation on the bottom end of the second or leading carton 13. The pivotally mounted tucker wings 14 through 17 are similarly constructed and, accordingly, the corresponding parts of these four tucker wings have been marked with the same reference numerals.

Figure 2:
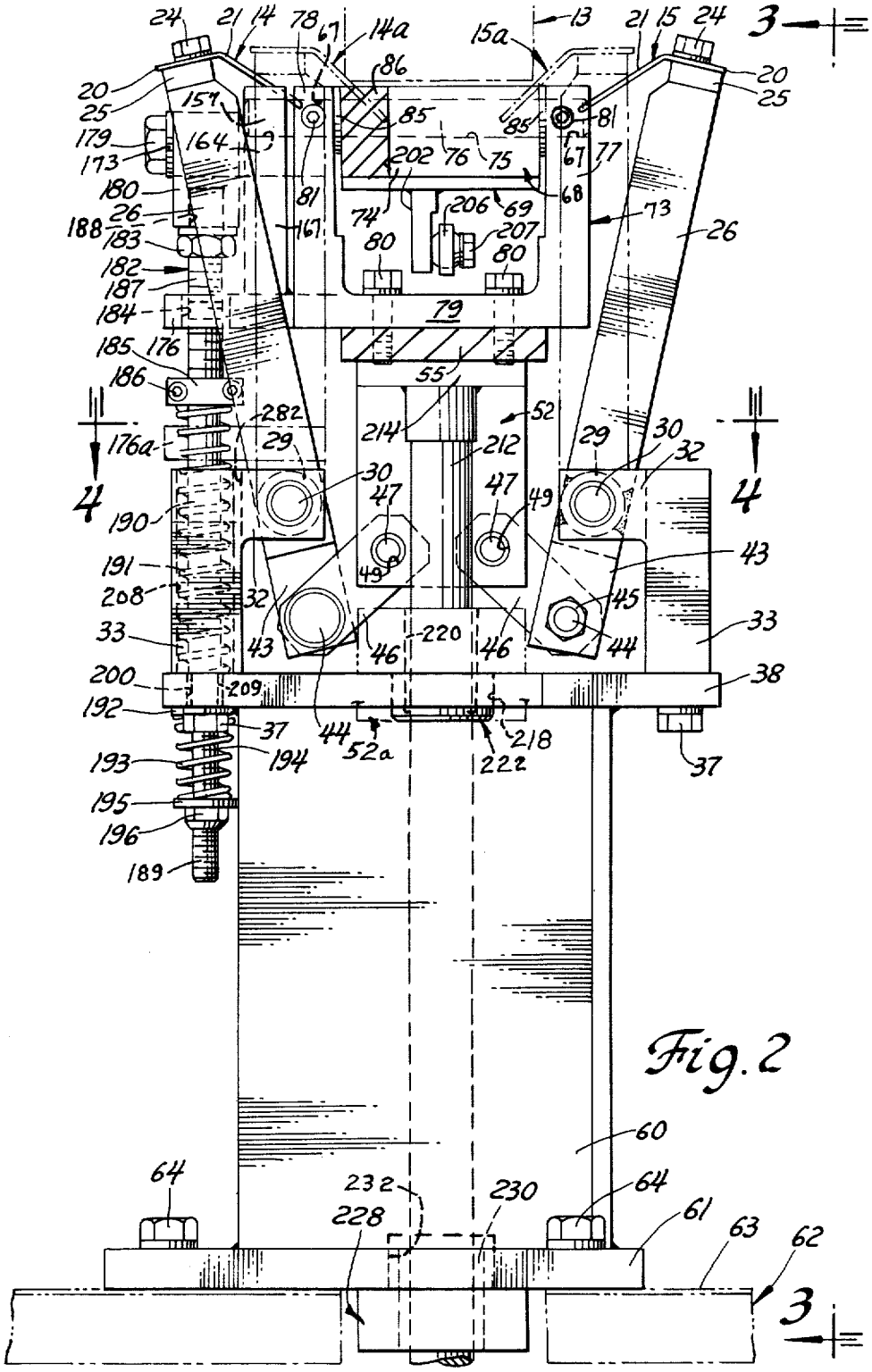
FIGS. 2 and 2A are elevation views, partly in section, of the tucker-tacker structure illustrated in FIG. 1, taken along the line 2—2 thereof, and looking in the direction of the arrows.

As shown in FIGS. 1 and 2, each of the tucker wings 14 through 17 includes a first outer plate-like mounting portion 20 to which is integrally formed an inwardly and downwardly sloping plate-like tucker and breaker portion 21. As best seen in FIG. 1, the inner end corners of each of the tucker wing portions 21 are removed to form the inward tapered corner edge portions 23 which terminate at a front end edge portion 22 which is parallel to the line of movement of the cartons 13 through the tucker-tacker assembly 10. The last mentioned structure substantially forms a triangular inner end on the tucker wing portions 21.

Figure 3:
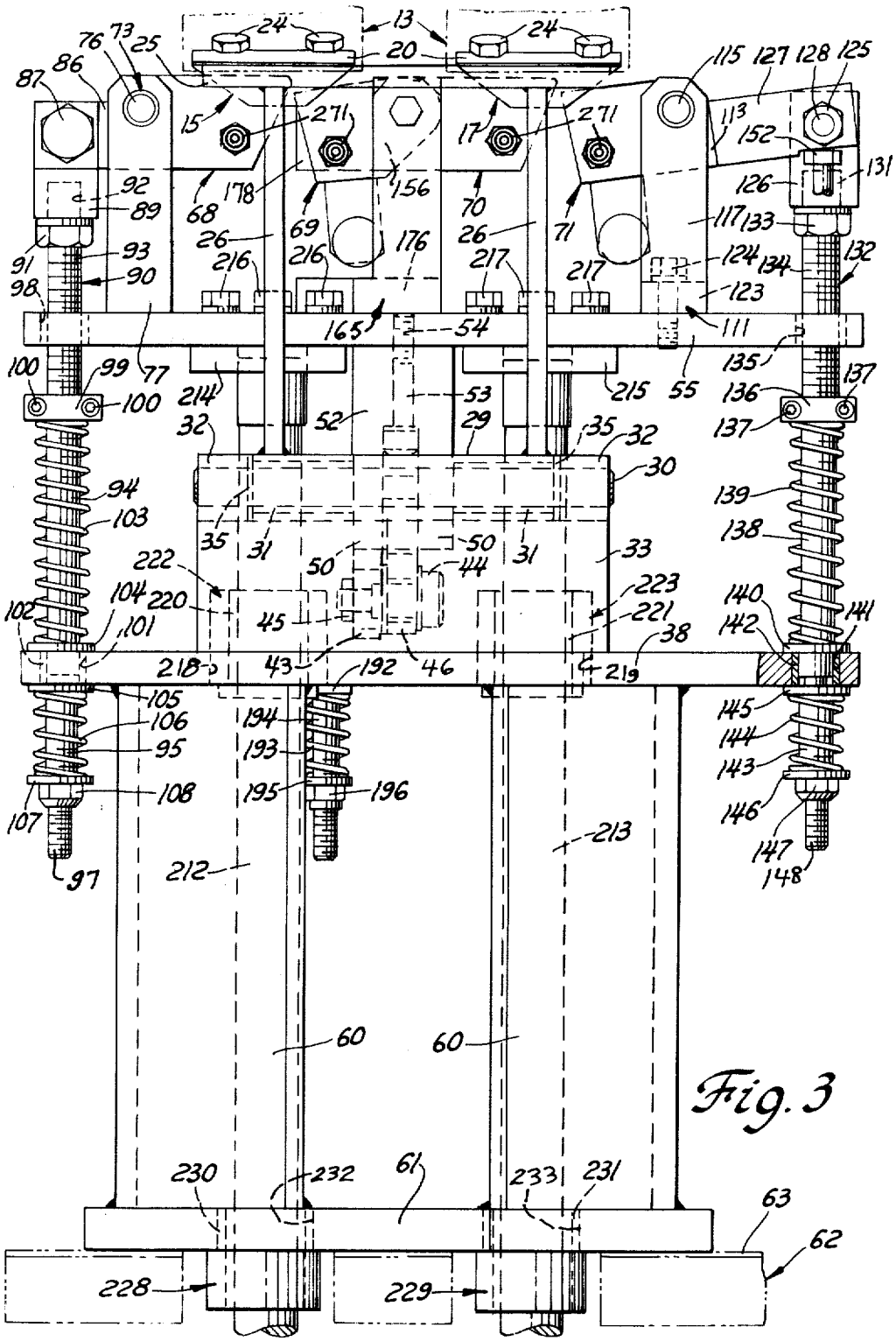
FIG. 3 is a right side elevation view of the tucker-tacker structure illustrated in FIG. 2, taken along the line 3—3 thereof, and looking in the direction of the arrows.
Figure 4:
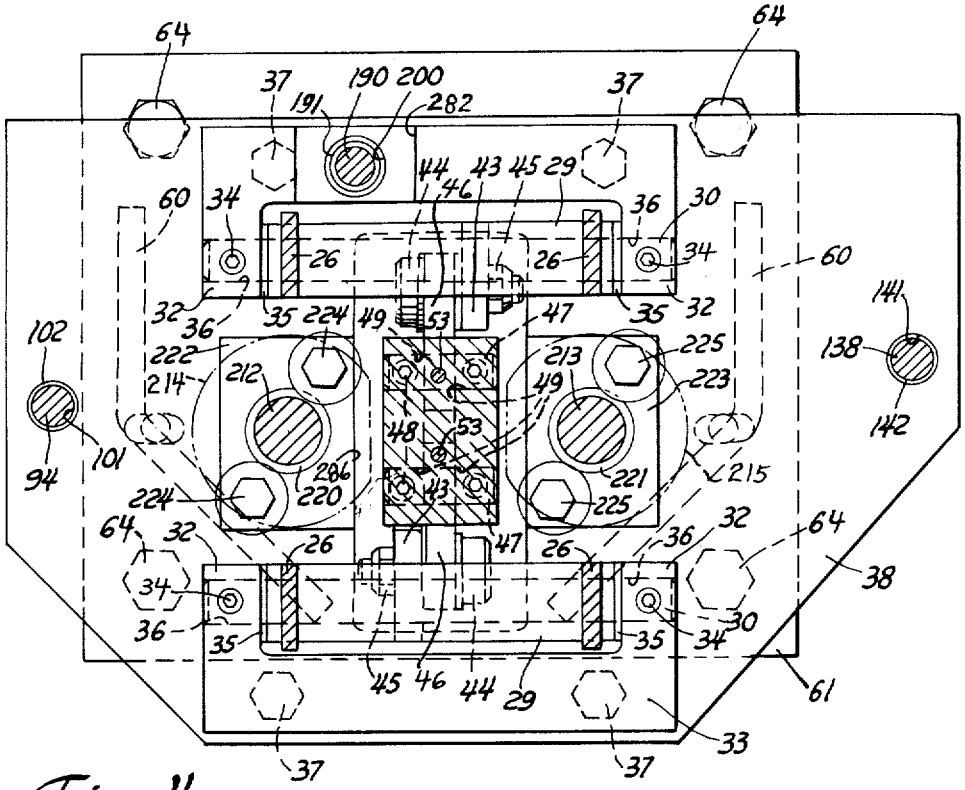
FIG. 4 is a horizontal section view of the tucker-tacker structure illustrated in FIG. 2, taken along the line 4—4, and looking in the direction of the arrows.

Each of the tucker wings 14 through 17 has its outer plate-like mounting portion 20 fixed to a longitudinally disposed mounting plate 25 by suitable machine screws 24. As shown in FIG. 1, the tucker wings 14 and 16 are secured to a first longitudinal mounting plate 25 on one side of the tucker-tacker assembly 10, and the tucker wings 15 and 17 are secured to a second longitudinal mounting plate 25 on the other side of the tucker-tacker assembly 10. As shown in FIG. 1, the longitudinal first and second mounting plates 25 are each fixedly secured, as by welding, to the upper ends of a pair of longitudinally spaced apart, vertically disposed, pivot arms or levers 26. As shown in FIGS. 3 and 4, the lower ends of each pair of levers 26 on the opposite sides of the tucker-tacker assembly 10, are fixedly secured, as by welding, to a longitudinally disposed sleeve shaft 29 which is pivotally mounted on a suitable pivot shaft 30. The ends of each of the pivot shafts 30 are fixedly mounted in suitable bores 36 formed in the extended, longitudinally spaced apart, pivot arms 32 (FIGS. 1 and 2). The ends of each of the pivot shafts 30 are secured in the bores 36 by suitable machine screws 34. The outer ends of the pivot arms 32 are integrally attached to the upper, outer ends of a longitudinally disposed pivot arm bracket plate 33. Each of the longitudinally disposed bracket plates 33 are fixedly secured by suitable machine screws 37 (FIGS. 2 and 4) to the upper side of a horizontally disposed, fixed upper mounting plate 38. The two sleeve shafts 29 are each mounted on their respective pivotal shafts 30 by a pair of longitudinally spaced apart suitable sleeve bushings 31 (FIG. 3). The ends of each of the sleeve shafts 29 are spaced apart from their two respective pivotal support arms 32 by a pair of washer bearings 35.

As shown in FIGS. 2 and 4, the upper end of a downwardly extended single pivot arm or lever 43, is fixedly secured, as by welding, to each of the sleeve shafts 29 on the lower side thereof, and at a centrally disposed position. As shown in FIG. 3, each of the pivot levers 43 is axially aligned with its respective pivot lever 26. As shown in FIGS. 2 and 4, the lower end of each of the pivot levers 43 is pivotally attached by a suitable machine screw 44 and nut 45 to the outer end of a pivot link 46. As shown in FIG. 2, the pivot links 46 are angularly disposed with their inner ends extended inwardly and upwardly in converging positions, and with their inner ends pivotally mounted to a pivot block, generally indicated by the numeral 52.

Figure 6:
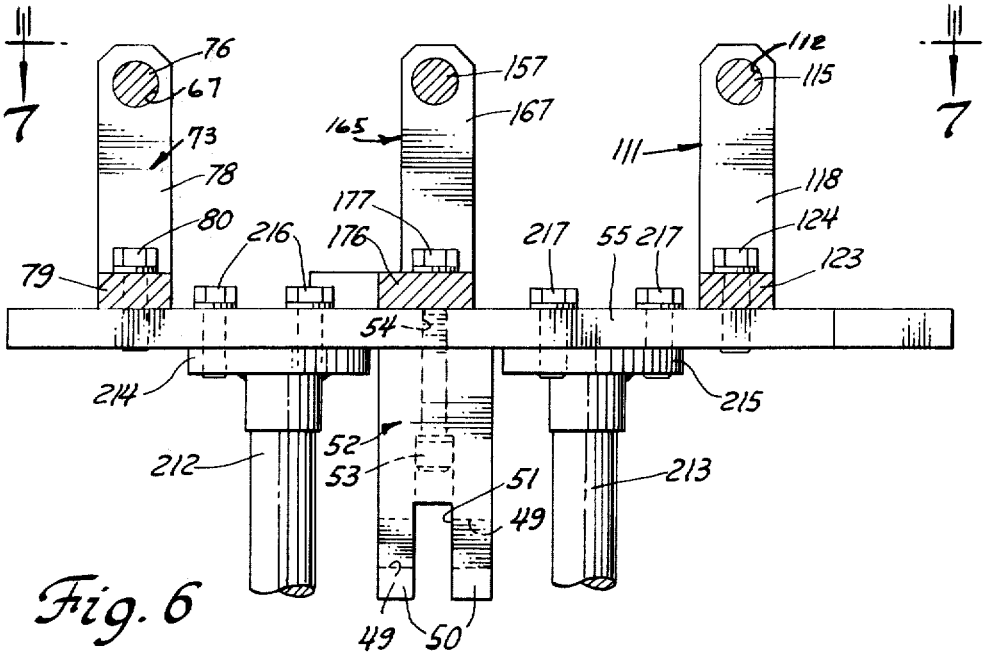
FIG. 6 is a fragmentary, elevation section view, with parts removed, of the tucker-tacker structure illustrated in FIG. 1, taken along the line 6—6 thereof, and looking in the direction of the arrows.

As shown in FIG. 3, the pivot block 52 is secured to the lower side of a movable carrier plate 55 by a pair of suitable machine screws 53 (FIG. 4) which are extended upwardly through the pivot block 52 and into threaded engagement with threaded bores 54 in the mounting plate 55. As shown in FIG. 6, the lower end of the pivot block 52 is provided with a transverse central slot 51 which forms a pair of depending support arms 50. As illustrated in FIGS. 2 and 4, each of the pivot links 46 has its inner end disposed in the slot 51 in the pivot block 52. The inner end of each of the pivot links 46 is pivotally secured to the pivot block 52 by a suitable pivot shaft 47, each of which has its ends mounted in a transverse bore 49 formed through the pivot block support arms 50. The ends of each of the pivot shafts 47 are secured in their respective bores 49 by suitable machine screws 48 (FIG. 4).

As shown in FIGS. 2, 3 and 4, the upper mounting plate 38 is supported on a pair of longitudinally spaced apart, vertical pedestal plates 60 which have an angular cross section (FIG. 4). The mounting plate 38 is secured to the upper end of the pedestal plates 60 by any suitable means, as by welding. The lower ends of the two pedestal plates 60 are seated on the upper side of a lower mounting plate 61 and they are secured thereto, by any suitable means, as by welding. As shown in FIGS. 2, 3 and 4, the lower mounting plate 61 is seated on the machine base plate 62 of the packaging machine with which the tucker-tacker assembly is associated. The lower mounting plate 61 is secured to the machine base plate 62 by any suitable means, as by suitable machine screws 64 (FIGS. 2 and 4). The numeral 63 in FIGS. 2 and 3 indicates the usual stainless steel cover plate which is mounted over the packaging machine base plate 62.

Figure 5:
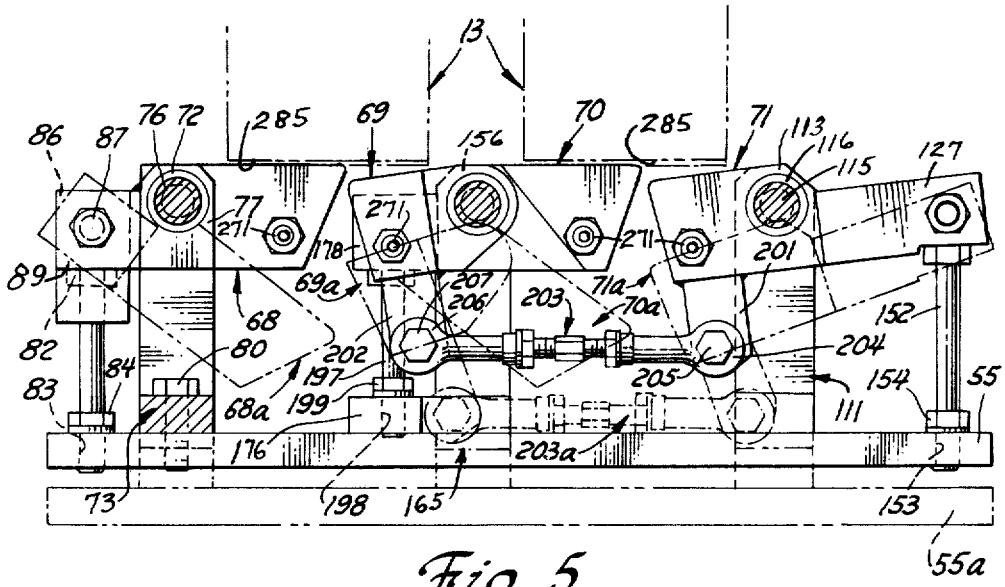
FIG. 5 is a fragmentary, elevation section view of the tucker-tacker structure illustrated in FIG. 1, taken along the line 5—5 thereof, and looking in the direction of the arrows.

As shown in FIGS. 1, 3 and 5, the tucker-tacker assembly 10 includes a first set of folding shoes or jaws, 68 and 69, and a second set of folding shoes or jaws 70 and 71 which are longitudinally spaced apart from the first set of folding shoes. As shown in FIGS. 1 and 5, the folding shoes 68 and 70 are longer than the folding shoes 69 and 71. The shorter shoes 69 and 71 are moved upwardly, to the carton bottom end closed position shown in solid lines in FIG. 5, a short time interval before the longer shoes 68 and 70 reach the closed position, so that the shorter shoes 69 and 71 can push a tuck flap of the carton bottom end closure members underneath a longer or over-lapping flap pushed by the longer shoes 68 and 70, when the folding shoes are operating on a carton bottom end which employs a tuck bottom end closure structure. However, it will be understood that the folding shoes 68 through 71 can also function to close a non-tuck bottom end closure structure. When employed to close the bottom end closure members of a tuck bottom end closure structure, the longer folding shoes 68 and 70 may be termed tacker jaws, and the shorter folding shoes 69 and 71 may be termed tucker jaws.

As shown in FIGS. 1 and 2, the tacker jaw 68 has a pivot arm plate 74 integrally formed on its outer end. The pivot arm plate 74 is provided with a transverse bore 75 through which is operatively mounted a transverse outer pivot shaft 76. The pivot arm plate 74 is mounted on the outer pivot shaft 76 by a pair of suitable sleeve bushings 72. The outer ends of the pivot shaft 76 are each mounted in a suitable bore 67 in one of a pair of transversely spaced apart, vertical bracket arms 77 and 78 of an outer support bracket, generally indicated by the numeral 73. As best seen in FIG. 2, the lower ends of the vertical bracket arms 77 and 78 are integrally attached to the ends of a transverse, horizontal mounting bar 79 which is secured by suitable machine screws 80 to the upper side of the movable carrier plate 55. The pivot arm plate 74 is spaced from the vertical bracket arms by a pair of suitable thrust washers 85. The pivot shaft 76 is fixed to the vertical bracket arms 77 and 78 by suitable machine screws 81 (FIG. 2).

As shown in FIG. 2, the pivot arm plate 74 has secured on the outer end thereof, as by welding, an outwardly extended hinge arm 86 which is hingedly connected by a suitable machine screw 87 and a lock nut 88 to a pivot block 89. As illustrated in FIGS. 1 and 5, a stop member in the form of an elongated suitable machine screw 82, has its head positioned beneath the hinge arm 86 so that the tacker jaw 68 will be limited in its upward movement to the solid line position shown in FIG. 5 by the fact that the bottom of the hinge arm 86 will abut against the head end of the stop screw 82. As shown in FIG. 5, the lower end of the stop screw 82 is threadedly mounted in a suitable threaded bore 83, which is formed in the outer end of the movable carrier plate 55, and it is secured in place by a suitable lock nut 84.

As shown in FIG. 3, a control rod, generally indicated by the numeral 90, has an upper threaded end 93 mounted in a threaded bore 92 which is formed in the lower end of the pivot block 89. The threaded rod end 93 is fixed in position by a suitable lock nut and washer means 91. The control rod threaded portion 93 extends downwardly through a suitable opening 98 formed through the upper mounting plate 55. A threaded collar 99 is threadably mounted on the lower end of the control rod threaded portion 93, and it is fixed in a desired adjusted position by a pair of suitable machine screws 100. The control rod 90 includes a central unthreaded portion 94 around which is mounted a suitable spring 103. The upper end of the spring 103 is seated against the lower end of the threaded collar 99, and the lower end thereof is seated on a washer 104 that is seated on the upper face of the fixed upper mounting plate 38. The control rod unthreaded portion 94 extends downwardly through a suitable bearing 102 which is mounted in a vertical bore 101 that is formed through the fixed upper mounting plate 38. The control rod 90 includes a lower unthreaded portion 95 that is extended below the upper mounting plate 38, and it terminates in a lower threaded end 97. A spring 106 is mounted around the control rod lower unthreaded portion 95 with its upper end abutting a washer 105 that is seated against the lower face of the upper mounting plate 38. The lower end of the spring 106 is seated on a washer 107, which is held in an adjusted position on the control rod 90 by a suitable nut 108 that is threadably mounted on the threaded lower end 97 of the control rod 90.

Figure 7:
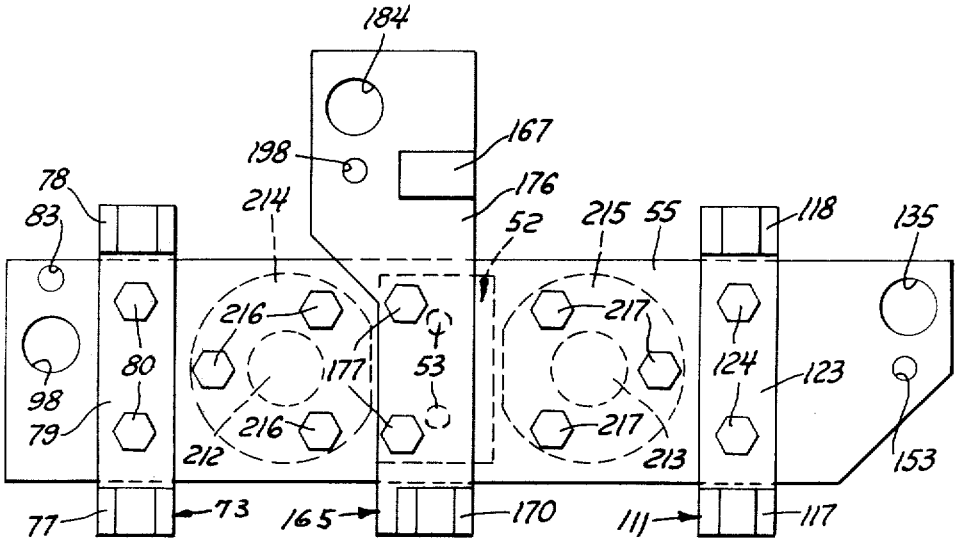
FIG. 7 is a top plan view of the tucker-tacker structure illustrated in FIG. 6, taken along the line 7—7 thereof, and looking in the direction of the arrows.

As shown in FIGS. 1 and 3, the tucker jaw 71 has an outer pivot arm plate 113 integrally formed on its outer end. The pivot arm plate 113 is provided with a transverse bore 114 through which is operatively mounted a transverse outer pivot shaft 115. The pivot arm plate 113 is mounted on the outer pivot shaft 115 by a pair of suitable sleeve bushings 116. The outer ends of the pivot shaft 115 are each mounted in a suitable bore 112 in a pair of transversely spaced apart, vertical bracket arms 117 and 118 on an outer support bracket, generally indicated by the numeral 111. As best seen in FIGS. 1, 3 and 7, the lower ends of the vertical bracket arms 117 and 118 are integrally attached to the ends of a transverse horizontal mounting bar 123. The horizontal mounting bar 123 is secured by suitable machine screws 124 (FIG. 7) to the upper side of the movable carrier plate 55. As shown in FIG. 1, the pivot arm plate 113 is spaced from the vertical bracket arms 117 and 118 by a pair of suitable thrust washers 119. The pivot shaft 115 is fixed to the vertical bracket arms 117 and 118 by suitable machine screws 120 (FIG. 1).

As shown in FIGS. 1 and 3, the pivot arm plate 113 has secured on the outer end thereof, as by welding, an outwardly extended hinge arm 127 which is hingedly connected by a suitable machine screw 128 and a lock nut 125 to a pivot block 126. As shown in FIG. 3, a control rod, generally indicated by the numeral 132, has an upper threaded end 134 mounted in a threaded bore 131 which is formed in the lower end of the pivot block 126. The upper threaded rod end 134 is fixed in position by a suitable lock nut and washer means 133. The control rod threaded portion 134 extends downwardly through a suitable opening 135 formed through the upper carrier plate 55. A threaded collar 136 is threadably mounted on the lower end of the control rod threaded portion 134, and it is fixed in a desired adjusted position by a pair of suitable machine screws 137.

The control rod 132 includes a central unthreaded portion 138, around which is mounted a suitable spring 139. The upper end of the spring 139 is seated against the lower end of the threaded collar 136, and the lower end thereof is seated on a washer 140 that is seated on the upper face of the fixed upper mounting plate 38. The control rod unthreaded portion 138 extends downwardly through a suitable bushing 142 which is mounted in a vertical bore 141 that is formed through the fixed upper mounting plate 38. The control rod 132 includes a lower unthreaded portion 143 that is extended below the upper mounting plate 38 and it terminates in a lower threaded end 148. A spring 144 is mounted around the control rod unthreaded portion 143 with its upper end abutting the washer 145 which is seated against the lower face of the upper mounting plate 38. The lower end of the spring 144 is seated on a washer 146 which is held in an adjusted position on the control rod 132 by a suitable lock nut 147 that is threadably mounted on a reduced diameter lower threaded end 148 of the control rod 132.

As illustrated in FIGS. 3 and 5, a stop member, in the form of an elongated suitable machine screw 152, has its head positioned beneath the hinge arm 127 so that the tucker jaw 71 will be limited in its upward movement to the solid line position shown in FIGS. 3 and 5, by the fact that the bottom of the hinge arm 127 will abut the head end of the stop screw 152. As shown in FIG. 5, the lower end of the stop screw 152 is threadably mounted in a suitable threaded bore 153 which is formed in the outer end of the movable carrier plate 55, and it is secured in place by a suitable lock nut 154.

As shown in FIG. 1, the tucker jaw 69 has a central pivot arm plate 156 integrally formed on its outer end. The pivot arm plate 156 is provided with a transverse bore 155 through which is operatively mounted a transverse inner pivot shaft 157. The pivot arm plate 156 is mounted on the inner pivot shaft 157 by a pair of suitable sleeve bushings 158.

As shown in FIG. 1, the tacker jaw 70 has a pair of integral pivot plates 159 and 160 formed on its inner end, and in transverse spaced apart positions so that they are transversely disposed on opposite sides of the pivot arm plate 156 of the tucker jaw 69. The pivot arm plates 159 and 160 are transversely spaced apart from the opposite sides of the pivot arm plate 156 by suitable thrust washers 161. The pivot arm plates 159 and 160 are operatively mounted on the inner pivot shaft 157 by suitable sleeve bushings 166.

The inner pivot shaft 157 is operatively mounted on an inner support bracket, generally indicated by the numeral 165 in FIGS. 1, and 5 through 7. As shown in FIG. 1, one end of the inner pivot shaft 157 is mounted in a suitable bore 164 in the vertical bracket arm 167 of the inner support bracket 165. The inner pivot shaft 157 is fixed in place by a suitable machine screw 168. The other end of the inner pivot shaft 157 is mounted in a suitable bore 163 in the transversely spaced apart vertical bracket arm 170 of the inner support bracket 165. The inner pivot shaft 157 is secured to the vertical bracket arm 170 by a suitable machine screw 171. The pivot arm plates 159 and 160 are spaced apart from the vertical bracket arms 167 and 170 by suitable thrust washers 169. As shown in FIGS. 6 and 7, the inner support bracket 165 includes an integral horizontal mounting bar 176 which is integrally attached to the lower end of the vertical bracket arms 167 and 170. The horizontal mounting bar 176 is fixedly secured to the movable carrier plate 55 by suitable machine screws 177.

As shown in FIG. 1, the tacker pivot arm plate 160 has fixedly connected thereto, as by welding, a longitudinally extended hinge arm 178 which is hingedly connected to a pivot block 180 by a machine screw 179. The machine screw 179 is extended through a bushing 175 in the pivot block 180 and into threaded engagement with a threaded bore 174 in the hinge arm 178. A thrust washer 173 is mounted between the head of the machine screw 179 and the outer end of the pivot block 180.

As shown in FIG. 2, a control rod, generally indicated by the numeral 182, has an upper threaded end 187 mounted in a threaded bore 188 which is formed in the lower end of the pivot block 180. The upper threaded rod end 187 is fixed in position by a suitable lock nut and washer means 183. The control rod threaded end portion 187 extends downwardly through a suitable opening 184 in the horizontal mounting bar 176 (FIG. 7). A threaded collar 185 is threadably mounted on the lower end of the control rod threaded portion 187, and it is fixed in a desired adjusted position by a pair of suitable machine screws 186.

The control rod 182 includes a central unthreaded portion 190, around which is mounted a suitable spring 191. The upper end of the spring 191 is seated against the lower end of the threaded collar 185, and the lower end thereof is extended through a suitable bore 208 formed through the pivot arm bracket plate 33 and into seating engagement on the upper face of the fixed upper mounting plate 38. The control rod unthreaded portion 190 extends downwardly through the spring 191 and the bore 208, and through a suitable bushing 209 mounted in a vertical bore 200 that is formed through the fixed upper mounting plate 38. The control rod 182 includes a lower unthreaded portion 194 that is extended below the upper mounting plate 38, and which terminates in a lower threaded end 189. A spring 193 is mounted around the control rod unthreaded portion 194 with its upper end abutting a washer 192 which is seated against the lower face of the upper mounting plate 38. The lower end of the spring 193 is seated on a washer 195 which is held in an adjusted position on the control rod 182 by a suitable lock nut 196 which is threadably mounted on the reduced diameter lower threaded end 189 of the control rod 182.

As illustrated in FIG. 5, a stop member, in the form of an elongated machine screw 197, has its head positioned beneath the hinge arm 178 so that the tacker jaw 70 will be limited in its upward movement to the solid line position shown in FIGS. 3 and 5, by the fact that the bottom of the hinge arm 178 will abut the head end of the stop screw head 197. As shown in FIG. 5, the lower end of the stop screw 197 is threadably mounted in a suitable threaded bore 198 which is formed in the outer end of the horizontal mounting bar 176 (FIG. 7). The stop member 197 is secured in place by a suitable lock nut 199.

As shown in FIG. 5, the tucker jaws 69 and 71 each have fixedly mounted on the lower side thereof, as by welding, a downwardly extended lever arm 202 and 201, respectively. The lever arms 201 and 202 are interconnected by a connecting rod which comprises a first rod end 204 which has one end pivotally connected to the lower end of the lever 201 by a socket head screw and lock nut means 205. The connecting rod also includes a second rod end 206 which has one end pivotally connected to the lower end of the lever 202 by a socket head screw and lock nut means 207. The rod ends 204 and 206 are operatively connected by a suitable turnbuckle screw, generally indicated by the numeral 203.

The power drive means, for operating the tucker jaws 69 and 71, and the tacker jaws 68 and 70, includes a pair of vertically disposed, longitudinally spaced apart, drive shafts 212 and 213, as illustrated in FIGS. 3, 4, 6 and 7. The upper ends of the drive shafts 212 and 213 are each fixedly secured, as by welding, to an annular flange 214 and 215, respectively. As best seen in FIGS. 3, 6 and 7, the annular flanges 214 and 215 are fixedly secured to the underside of the movable carrier plate 55 by a plurality of suitable machine screws 216 and 217, respectively. As illustrated in FIGS. 3 and 4, the drive shafts 212 and 213 extend down through suitable cartridge bearings, generally indicated by the numerals 222 and 223. The cartridge bearings 222 and 223 are provided with suitable bushings 220 and 221, respectively. The cartridge bearings 222 and 223 have reduced diameter lower ends operatively mounted in suitable bores 218 and 219, respectively, in the mounting plate 38, and they are secured to the mounting plate 38 by suitable machine screws 224 and 225, respectively, (FIG. 4).

As best seen in FIG. 3, the drive shafts 212 and 213 extend downwardly from the upper mounting plate 38 through a pair of suitable cartridge bearings, generally indicated by the numerals 228 and 229, which are operatively mounted on the lower mounting plate 61. The cartridge bearings 228 and 229 have reduced diameter upper ends which are operatively mounted in suitable bores 232 and 233, respectively, in the lower mounting plate 61. The cartridge bearings 228 and 229 are secured by suitable machine screws (not shown) to the mounting plate 61. The cartridge bearings 228 and 229 each carries a bushing, as 230 and 231, respectively, through which the drive shafts 212 and 213, respectively, are slidably mounted.

Figure 2A:
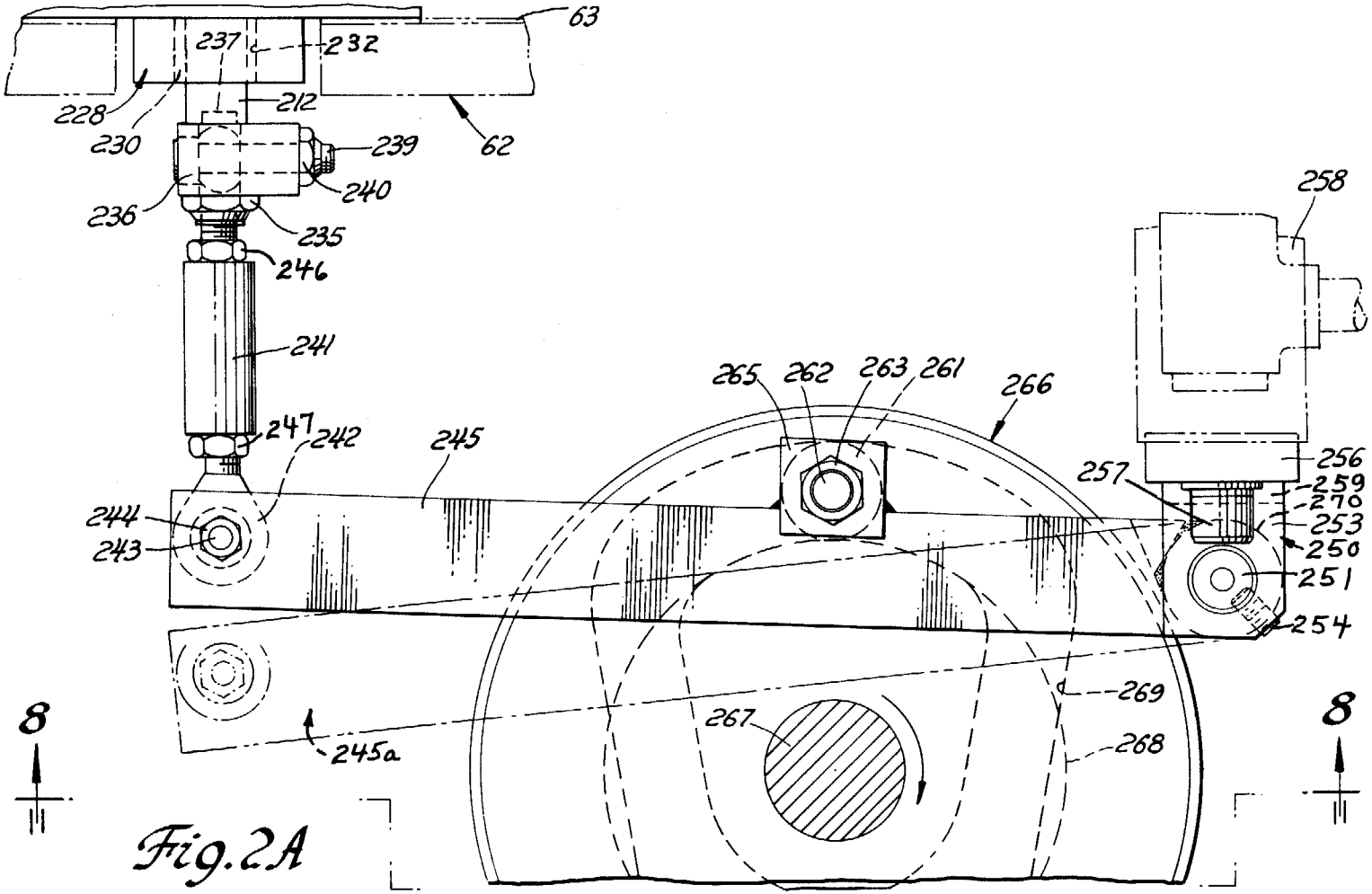
Figure 8:
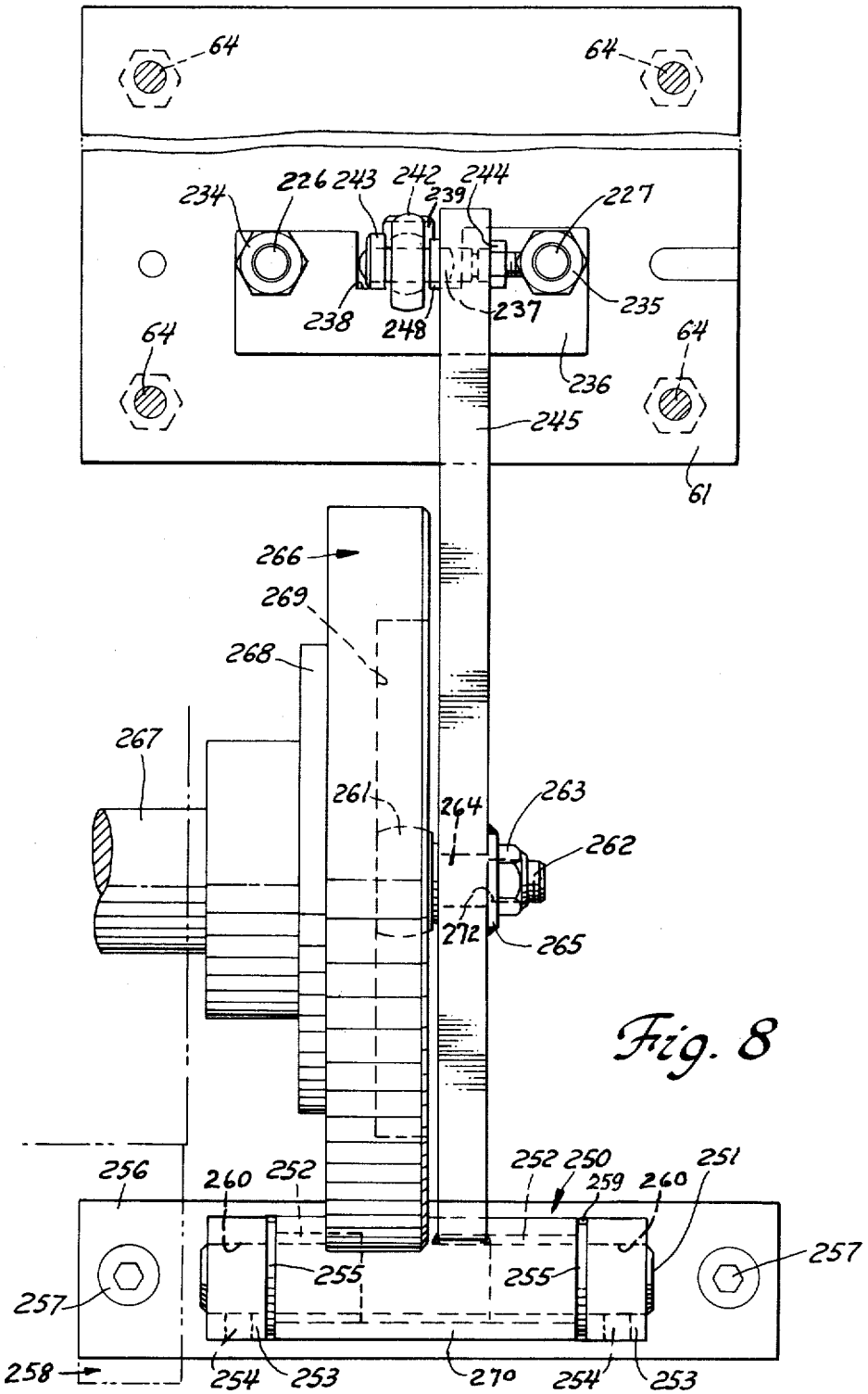
FIG. 8 is a bottom plan view of the tucker-tacker structure illustrated in FIG. 2A, taken along the line 8—8 thereof, and looking in the direction of the arrows.

As shown in FIGS. 2A and 8, a longitudinally extended, horizontal, tie bar 236 is disposed across the lower ends of the drive shafts 212 and 213. The drive shafts 212 and 213 are provided with reduced diameter, threaded lower ends, as indicated by the numerals 226 and 227 in FIG. 8. The reduced diameter threaded lower ends 226 and 227 of the drive shafts 212 and 213 extend through suitable bores formed through the tie plate 236, and they are secured to the tie plate 236 by suitable lock nuts 234 and 235. As shown in FIG. 8, the tie bar 236 thus connects the lower ends of the drive shafts 212 and 213, and it is provided with a centrally disposed rectangular recess 238 along one side thereof.

A rod end member 237 has one end disposed in the recess 238 in the tie plate 236, and it is fixedly secured to the tie plate 236 by a suitable shoulder screw 239 and a lock nut 240 (FIG. 2A). The rod end member 237 has its other end threaded, and it is operatively connected to one end of a tubular adjusting nut 241 and fixed in an adjusted position by a suitable lock nut 246. The other end of the tubular adjusting nut 241 is threadably attached to the threaded end of a second rod end member 242, and it is secured in place by a suitable lock nut 247. As best seen in FIG. 8, the rod end member 242 is operatively attached to one end of a tucker-tacker lever 245 by a suitable shoulder screw 243, a thrust washer 248, and lock nut 244 (FIG. 8).

As shown in FIGS. 2A and 8, the rear end of the tucker-tacker lever 245 is hingedly supported by a pivot bracket structure, generally indicated by the numeral 250. The pivot bracket structure 250 includes a horizontally disposed pivot shaft 251 which has its ends operatively mounted in suitable bores 260 formed through a pair of spaced apart, vertically disposed mounting plates 253 (FIG. 8). The ends of the pivot shaft 251 are secured in their respective bores 260 in the plate 253 by suitable set screws 254. The rear end of the tucker-tacker lever 245 is fixedly secured, as by welding, to a pivot hub 270 which is disposed between the shaft support plates 253 and pivotally supported on the pivot shaft 251 by a pair of spaced apart bushings 252. The pivot hub 270 is spaced from the shaft support plates 253 by a pair of suitable thrust washers 255. The shaft support plates 253 are spaced apart by a longitudinally disposed spacer plate 259. The spacer plate 259 and the support plates 253 are secured to the lower side of an elongated mounting plate 256, by any suitable means, as by welding. As shown in FIGS. 2A and 8, the mounting plate 256 is secured by a pair of suitable machine screws 257 to the packaging machine support structure 258.

As shown in FIGS. 2A and 8, a cam roller follower 261 is rollably secured to the tucker-tacker lever 245 at an intermediate position thereon. As best seen in FIG. 8, the cam roller follower 261 is provided with a conventional mounting shaft 264 which has a reduced diameter, threaded end 262 that is extended through a bore 272 formed through a support flat washer 265. The support flat washer 265 is fixed to one side of the lever 245 by any suitable means, as by welding. The shoulder formed between the cam follower shaft 264 and its reduced diameter threaded end 262 is seated against one side of the flat washer 265, and a suitable lock nut 263 is mounted on the threaded shaft end 262 on the other side of the washer 265 and it fixedly secures the cam roller follower 261 in an operative position on the lever 245.

As shown in FIGS. 2A and 8, the cam roller follower 261 is rollably mounted in a suitable tucker-tacker cam track 269 formed in one side of a rotatable tucker-tacker cam, generally indicated by the numeral 266. A timing hub 268 is secured to one side of the tucker-tacker cam 266, as shown in FIGS. 2A and 8. The tucker-tacker cam 266 is operatively mounted on the drive shaft 267 of the packaging machine with which the tucker-tacker assembly 10 is associated, by any suitable means, for operation of the tucker-tacker assembly 10 in a suitable timed relationship with the other operating carton processing apparatus of the packaging machine.

As shown in FIGS. 3 and 5, the tucker jaws 69 and 71, and the tacker jaws 68 and 70 are each provided with a suitable coolant water inlet fitting 271 for supplying coolant water to passages (not shown) for cooling the jaws. Similar suitable outlet fittings are provided on the other side of these jaws for discharging the coolant water after it has performed its conventional cooling action.

In operation, the rotary turret of the packaging machine would move a pair of the cartons 13 into side-by-side positions, as shown in FIG. 1, for a closing and tacking operation on the bottom end closure members of two cartons, by the tucker-tacker assembly 10 of the present invention. The cartons 13 may be of the gable or flat top type as shown in U.S. Pat. Nos. 3,120,333; 3,185,375; 3,185,376; 3,270,940; 3,294,310; and 3,406,892. It will be understood that the operator's controls for the tucker-tacker assembly 10 of the present invention would be incorporated into the overall operator's control means for the packaging machine with which the tucker-tacker assembly 10 of the present invention is associated, and a suitable control circuit means may be employed for timing and controlling the operations of the tucker-tacker assembly 10, since the control circuit means does not form any part of the present invention.

When the rotary turret of the packaging machine with which the tucker-tacker assembly 10 is used has moved a pair of cartons 13 into the position shown in FIG. 1, at the bottom end closing station, the packaging machine main drive shaft 267 is timed to rotate the tucker-tacker cam 266 in the clockwise direction, as viewed in FIG. 2A, so that the tucker-tacker cam roller follower 261 is moved downwardly in the cam track 269 to lower the tucker-tacker lever 245 from a raised, inoperative, solid line position, indicated by the numeral 245 in FIG. 2A, to a lowered, broken line position shown at 245*a* in FIG. 2A. The downward movement of the tucker-tacker lever 245 moves the pivot block 52, as shown in FIG. 2, from the solid line inoperative position, indicated by the numeral 52 in FIG. 2, to the broken line position 52*a* shown in FIG. 2. When the tucker-tacker lever 245 is in the inoperative, solid line position in FIG. 2A, the tucker wings 14 through 17 are in the withdrawn, solid line positions shown in FIGS. 1 and 2. The tucker jaws 69 and 71, and the tacker jaws 68 and 70 are in the lowered inoperative broken line positions, shown by the numerals 68*a* through 71*a* in FIG. 5, when the tucker-tacker lever 245 is in the operative broken line position 245*a* of FIG. 2A.

As shown in FIG. 4, the fixed upper mounting plate 28 is provided with a rectangular opening 286 to permit the downward movement of the pivot block 52 from the solid line position shown in FIG. 2 to the broken line position 52*a* in FIG. 2 when the tucker-tacker assembly 10 is in the operative position. When the pivot block 52 is in the lowered operative position 52*a*, as illustrated in FIG. 2, it will be understood that the pivot links 46 (FIG. 4) will be in lowered positions so that the inner ends thereof would converge downwardly, instead of upwardly as shown in FIG. 2.

The relative movements of the tucker wings 14 through 17, and the tucker jaws 69 and 71, and the tacker jaws 68 and 70, are described generally, and they will then be described in more detail in relation to the specific movements of these members, as shown in detail in FIGS. 9 through 19.

It will be understood that when the pivot block 52 is moved downwardly from the solid line position of FIG. 2, to the lowered broken line position 52*a*, that the tucker wings 14 through 17 will move from their retracted outward positions, shown in FIG. 2 by the tucker wings 14 and 15, to the inward or tucking positions shown by the broken line positions 14*a* and 15*a*, and then back to their retracted positions. It will also be understood that when the pivot block 52 moves from the lowered position 52*a* back up to the solid line position due to the continued rotation of the cam 266, that the tucker wings 14 through 17 will again be actuated through the inward and outward movements. Because the pivot links 46 pass over center on the downward movement of the pivot block 52, and again pass over center on the upward movement of the pivot block 52, the tucker wings 14 through 17 are moved inwardly and outwardly twice during one bottom end closing operation, with the first inward movement of the tucker wings being the movement that carries out a tucking operation on the triangular bottom end closure members 280 and 281, and with the second inward movement being merely a non-tucking movement due to the inherent nature of the driving mechanism of the tucker-tacker assembly 10.

Figure 12:
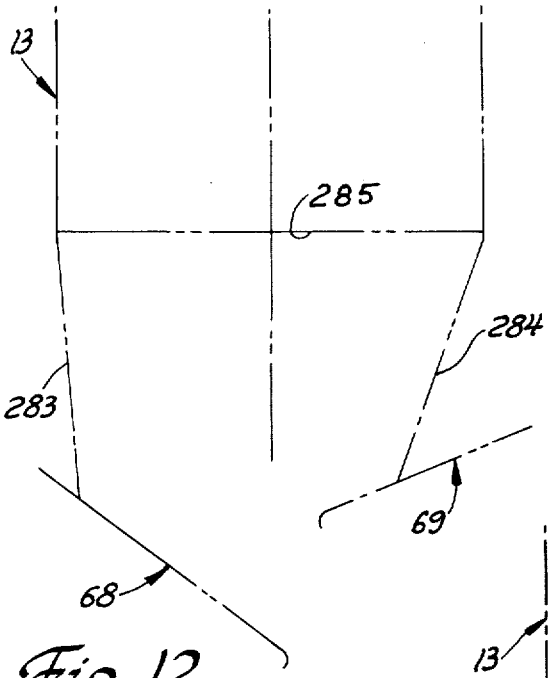
FIGS. 12 through 20 show a series of progressive steps of the tucker and tacker jaws as they are moved through the sequence of tucking and tacking operations.
Figure 14:
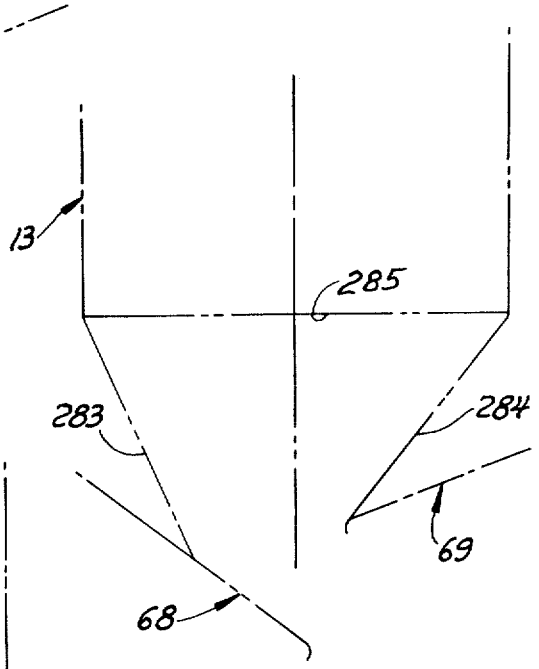
Figure 13:
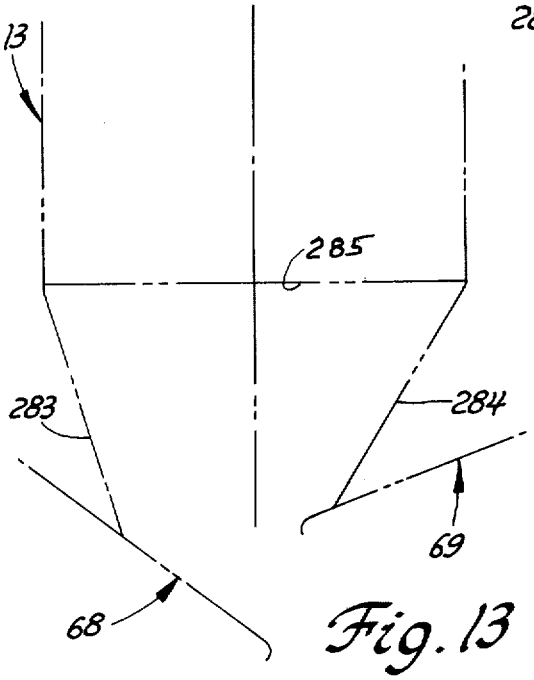
Figure 15:
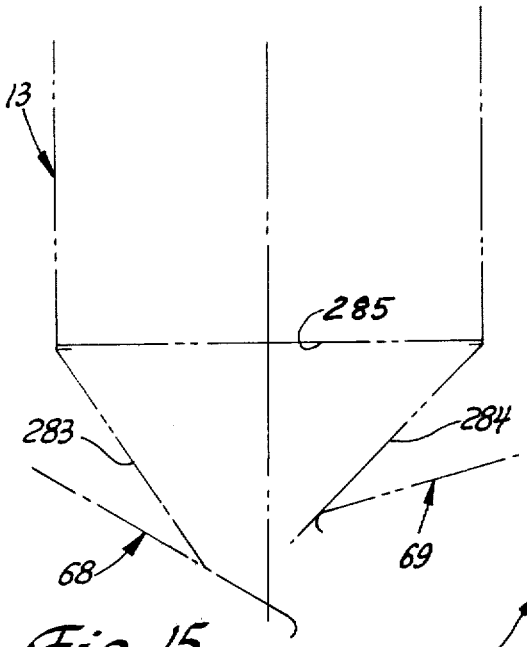
Figure 17:
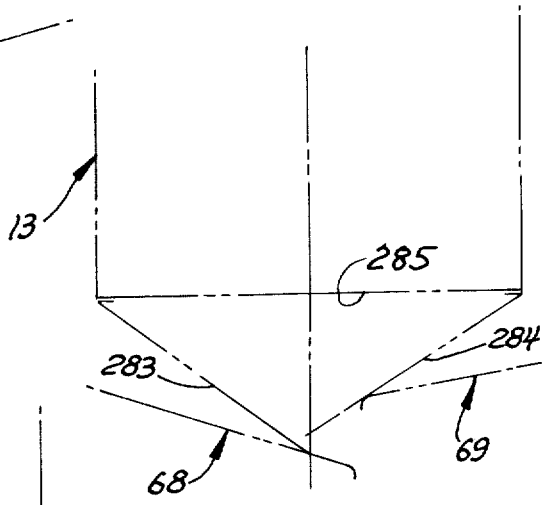
Figure 16:
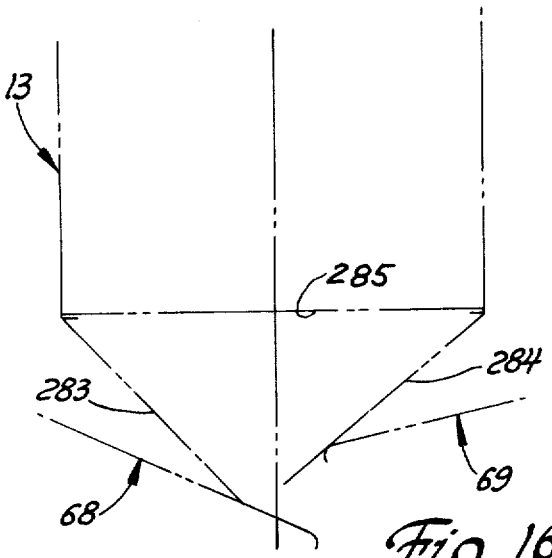
Figure 18:
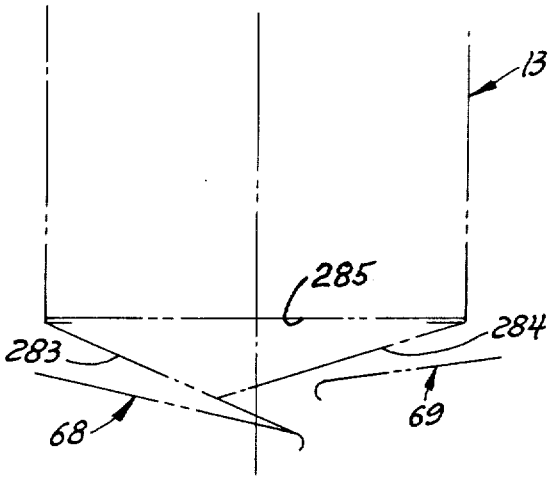

When the pivot block 52 is in the lowered position 52*a*, shown in FIG. 2, the movable carrier plate 55 which is attached to the pivot plate 52 is in the lowered position 55*a* as shown in FIG. 5, with the tucker jaws and tacker jaws in the inoperative broken line positions shown by the numerals 68*a* through 71*a*. When the cam 266 is rotated to move the tucker-tacker lever to the solid line position 245 in FIG. 2A, the pivot block 52 moves the carrier plate 55 upwardly and the tucker jaws 69 and 71 operatively engage the tuck-in flaps 284 of the two cartons 13 in the bottom end closing station shown in FIG. 1, and the tacker jaws 68 and 70 operatively engage the tuck-over flaps 283 of the two cartons 13. FIG. 12 shows the initial contact and beginning of the tucking and tacking action of the tucker jaws 69 and 71 and the tacker jaws 68 and 70, on the tuck-in flaps 284 and the tuck-over flaps 283, respectively.

Figure 20:
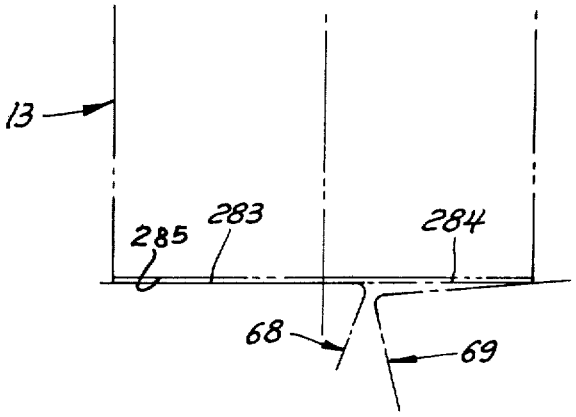
Figure 19:
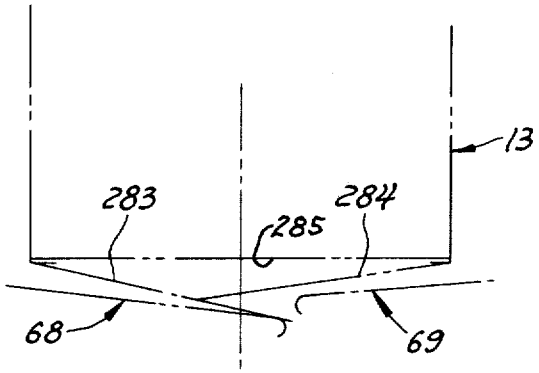

FIGS. 13 through 20 show the continuation of the tucking and tacking movements of the last mentioned tucker and tacker jaws as the movable carrier plate 55 is moved upwardly to the solid line position shown in FIG. 5 to bring the said tucker and tacker jaws to the closed, solid line position shown in FIG. 1. FIG. 20 shows the final positions of the tucker jaw 69 and the tacker jaw 68 when the bottom end of a carton 13 has been fully closed and tacked, and it will be understood that the mating tucker jaw 71 and tacker jaw 70 would also be in similar positions.

It will be understood that as a carrier plate 55 moves upwardly, the tucker jaws 69 and 71, and the tacker jaws 68 and 70 are rotated from the inoperative broken line positions 68*a* through 71*a* shown in FIG. 5 to the solid line positions by being rotated about their respective mounting shafts 76, 57 and 115 (FIG. 6). The control or pull rods 90, 182 and 132 function through their respective pivot blocks, which are attached to their respective tucker and tacker jaws, to pivot the jaws through their operative movements as the carrier plate 55 is moved upwardly. The last mentioned control rods all have an over-load spring which hits a stop and causes the control rods to pivot the tucker and tacker jaws from the initial contact position shown in FIG. 12, through the continuous folding movements shown in FIGS. 13 through 20. The outer ends of the levers carrying the tucker and tacker jaws hit the stops 82, 152, and 197, and the control rods go into an over-ride condition with the springs allowing the control rods to over-travel a slight amount to insure that the folding operation has gone through a complete cycle.

It will be noted that the tucker jaws 69 and 71, as shown in FIG. 1, are shorter than the tacker jaws 68 and 70, so that the tuck-in flap 284 is moved inwardly ahead of the overlapping tuck-over flap 283 of a carton bottom end closure structure to insure that the tuck-in flap 284 is in the correct position. As the tucker and tacker jaws 69 and 71, and 68 and 70, respectively, move through the closing steps shown in FIGS. 12 through 20, the longer tacker jaws 68 and 70 move up and apply pressure to the overlapping tuck-over flaps 283, and they apply this pressure across the center of a carton bottom, and the mandrels on which the cartons are mounted are water cooled, and therefore the closed carton ends are pressed against water cooled mandrel caps and the closure members at the carton bottom end are chilled sufficiently to tack them into a closed position. After the tuck-over flaps 283 and the tuck-in flaps 284 have been tacked into position, the operating lever 245 moves downwardly again to move the pivot block 52 and carrier plate 55 downwardly to open the tucker and tacker jaws 69 through 71. The tucker wings 14 through 17 will go inward and outward again but they do not perform any operations, and the cartons 13 with their closed bottom ends are then indexed out of the bottom end closing station to the bottom pressure station, generally indicated by the numeral 12, where the carton bottom ends are permanently sealed in position.

Figure 10:
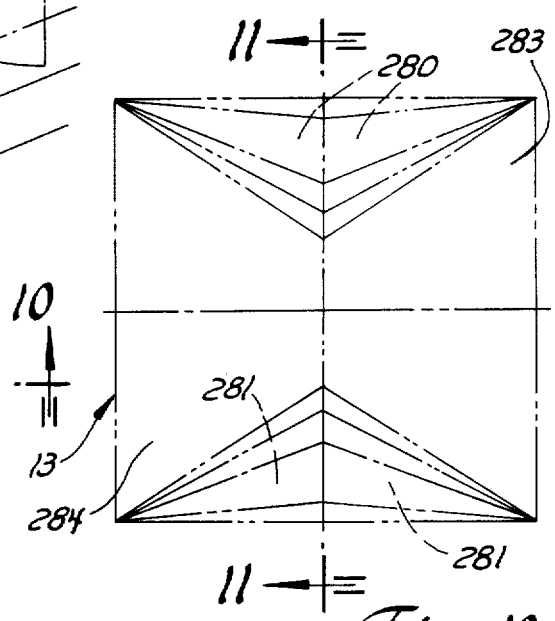
FIG. 10 is a bottom view of the tucker-tacker structure illustrated in FIG. 9, and showing a diagram of the progressive steps of the tucker wing gussets as they are moved through a carton bottom end breaking operation.
Figure 11:
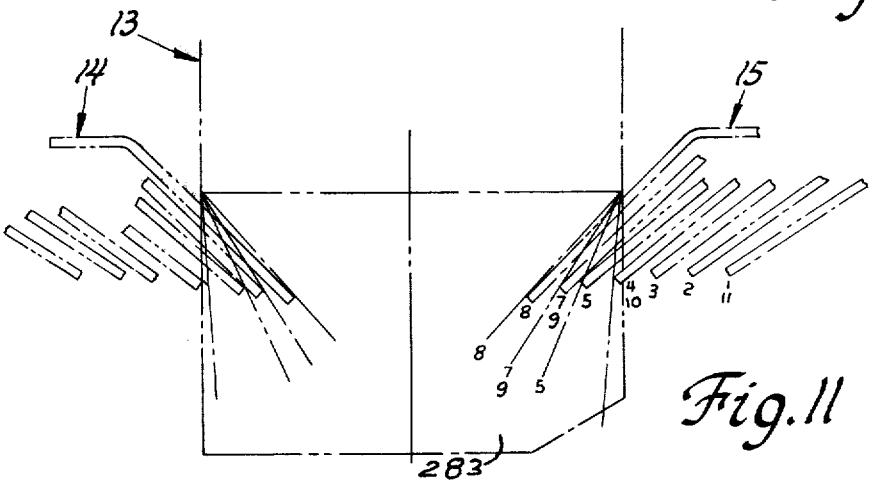
FIG. 11 is a transverse view of the structure shown in FIG. 10, taken along the line 11—11 thereof, and looking in the direction of the arrows.

FIG. 11 is a transverse view of the structure shown in FIG. 10, and showing the progressive inward and outward movement steps of one pair of tucker wings, namely, 14 and 15, as they are moved inwardly from the solid line position shown in FIG. 2, through steps marked 1 through 8, to the broken line position shown in FIG. 2, and then outwardly through the steps 8 through 11 back to the solid line position shown in FIG. 2.

Figure 9:
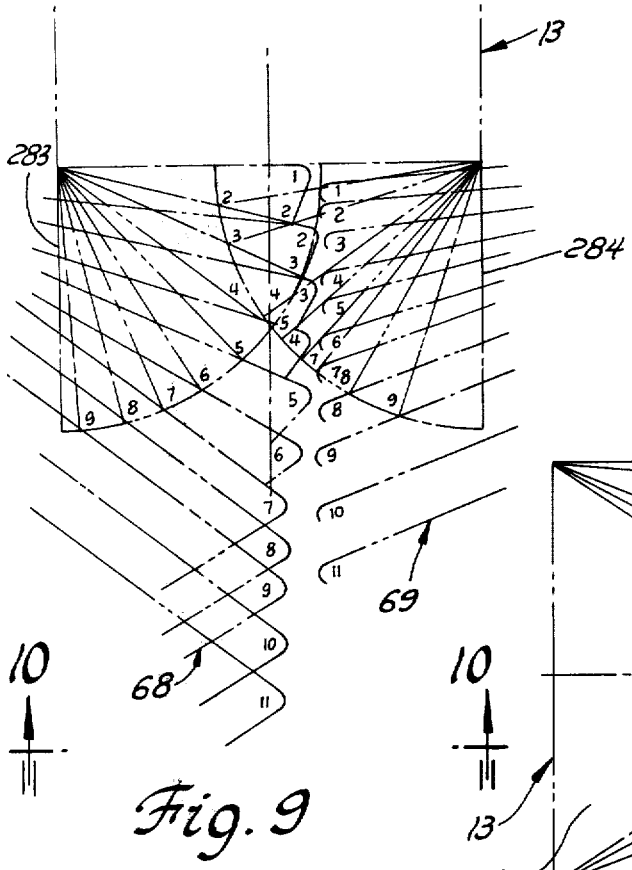
FIG. 9 is a diagram showing the progressive steps of the tucker-tacker jaws as they go through the sequence of steps for folding the tucking flap and the bottom flap, and tacking these flaps in the closed position.

FIG. 9 is a diagram showing the progressive steps that one set of tucker and tacker jaws, 68 and 69, go through for folding a tuck-in flap 284 and a tuck-over flap 283 of a carton bottom into closed positions. The movements of the tacker and tucker jaws 68 and 69 are indicated by numerals 11 through 1, with 11 indicating the initial contact position shown in FIG. 12, and the numeral 1 indicating the final position of these tucker and tacker jaws as shown in FIG. 20. The positions of the tuck-in flap 284 and the tuck-over flap 283 are also indicated by numerals 9 through 1 which indicate the folding steps that these flaps are moved through as the tucking and tacking jaws are moved through the steps 11 through 1 shown in FIG. 9.

It will be seen that because the bottom closure members of a carton are tacked in a closed position by the tucker-tacker apparatus of the present invention, that they will not reopen, and that they will stay in the fully folded condition so that there is no distortion of the carton bottom end closure members when the cartons are in motion and moved from one operative station to another, as when a conveyor moves them from the bottom closing station to the bottom pressure station 12. The tucker-tacker apparatus of the present invention provides symmetrical bottoms as compared to the prior art tucker-tacker apparatuses wherein the folding operation is carried out as the cartons are moved between working stations. With the tucker-tacker apparatus of the present invention, all the folding is done at one station when the cartons are in a stationary position, and the cartons tend to equalize themselves on their supporting mandrels so that all the folds are made equally, and there is equal clearance between the bottom end of the carton and the supporting mandrel so that all the folds are made in accordance with the score lines on the closure members. An advantage of the tucker-tacker apparatus of the present invention is that it provides a consistently good carton bottom end closure structure which is equal to the quality of the carton blank itself. The prior art tucking and tacking machines tuck the carton bottom end closure members and then they move the cartons, and then they seal the bottom ends of the cartons without the precise tacking operation carried out by the apparatus of the present invention. The tucker-tacker apparatus of the present invention includes an active tucker means, that is the tucker wings 14 through 17, which have shaped inner ends that insure that the triangular bottom end closure members 280 and 281 fold accurately along their fold lines on the carton blank. The tucker-tacker apparatus of the present invention is particularly adapted for use on large cartons, as for example, half-gallon cartons and up.

The tucker-tacker apparatus 10 of the present invention is especially adapted for use with an indexing packaging machine which indexes a pair of cartons through a carton forming, filling and closing path.

INDUSTRIAL APPLICABILITY

The carton bottom tucking and tacking apparatus of the present invention is adapted for use with carton packaging machines which package liquid products, granular products, and similar products capable of being loaded into a gable or flat top type carton or container from a flow type filler apparatus, as for example, various dairy products, soft drinks, flowable solid food products, and liquid type products such as oils and the like.

We claim:

1. A carton bottom tucker-tacker assembly for use in a packaging machine for forming, filling and closing the bottom ends of a pair of cartons, and wherein said packaging machine includes at least two carton mandrels for holding a pair of cartons in side-by-side positions for closing the bottom end closure members of the pair of cartons after said bottom ends have been heated, and wherein said bottom end closure members include a pair of hingedly mounted opposed triangular closure members and a pair of opposed tuck-in and tuck-over flaps disposed perpendicular to the triangular closure members, characterized in that the tucker-tacker assembly includes:

(a) a tucker apparatus operatively mounted at a carton bottom forming station in the packaging machine beneath each one of said pair of cartons for simultaneous engagement with the bottom closure triangular members of said pair of cartons retained on the pair of carton mandrels for breaking and partially folding the same toward a closed position;

(b) a tucker jaw swingably mounted at said carton bottom forming station beneath each of said pair of cartons for engaging simultaneously the partially closed bottom closure tuck-in flap members of each of said pair of cartons and moving the tuck-in flap members thereof toward closed positions;

(c) a tacker jaw swingably mounted at said carton bottom forming station beneath each of said pair of cartons for engaging simultaneously the partially closed bottom closure tuck-over flap members of each of said pair of cartons and moving the tuck-over panel members thereof toward closed positions and tacking the closed bottom closure members in place;

(d) power drive means for operating each of the tucker apparatuses, the tucker jaws and the tacker jaws;

(e) each of said tucker apparatuses including a pair of opposed tucker wings, each of said tucker wings including a formed inner end that has converging tapered edges for engagement with a bottom end triangular closure member on one of said pair of cartons for breaking and partially folding the same when the tucker wing is moved from a retracted outward position to an advanced inward position;

(f) a mounting plate supported on the packaging machine;

(g) means for swingably mounting each of said pair of opposed tucker wings of each tucker apparatus for swinging movement between said retracted outward and advanced inward positions;

(h) a movable pivot block member operatively connected to said power drive means;

(i) toggle link means interconnecting said pivot block and tucker wings;

(j) a carrier plate mounted on said pivot block for movement therewith;

(k) means for pivotally mounting said tucker and tacker jaws on said carrier plate; and (l) a plurality of spring-loaded control rods operatively connected to said tucker and tacker jaws for coaction with the carrier plate when it is moved with said pivot block to swing the tucker and tacker jaws from retracted inoperative positions to inwardly advanced operative positions for folding the tuck-in and tuck-over flaps of the pair of cartons to closed and tacked positions.

2. A carton bottom tucker-tacker assembly as defined in claim 1, is characterized in that said assembly includes:

(a) stop means for limiting the advanced inward folding movements of the tucker and tacker jaws.

3. A carton bottom tucker-tacker assembly as defined in claim 2, characterized in that said power drive means includes:

(a) an operating rod having one end fixed to said pivot block;

(b) a lever arm having one end hingedly connected to the other end of said operating rod and the other end pivotally mounted on the packaging machine; and, (c) cam means for pivoting said lever arm for moving the operating rod upwardly and downwardly for moving the tucker and tacker jaws between retracted, inoperative positions and advanced, operative positions.

4. A carton bottom tucker-tacker assembly as defined in claim 3, characterized in that:

(a) said tucker and tacker jaws are water cooled.

5. A carton bottom tucker-tacker assembly as defined in claim 1, wherein:

(a) each pair of swingably mounted tucker wings, for each of said pair of cartons, swing inwardly and outwardly in planes transverse to the direction of movement of the pair of cartons through the packaging machine; and, (b) the tucker and tacker jaws of each pair of said jaws are pivotally mounted on axes that are disposed transverse to said direction of movement of the pair of cartons.

* * * * *